United States Patent [19]

Sinsky et al.

[11] 4,086,597

[45] Apr. 25, 1978

[54] CONTINUOUS LINE SCANNING TECHNIQUE AND MEANS FOR BEAM PORT ANTENNAS

[75] Inventors: Allen I. Sinsky; Paul C. Wang; Robert E. Willey, all of Baltimore, Md.

[73] Assignee: The Bendix Corporation, Southfield, Mich.

[21] Appl. No.: 752,657

[22] Filed: Dec. 20, 1976

[51] Int. Cl.[2] ..... H01Q 19/06

[52] U.S. Cl. ..... 343/754; 343/854

[58] Field of Search ..... 343/854, 754, 755

[56] References Cited

U.S. PATENT DOCUMENTS

| | | | |
|---|---|---|---|
| 3,761,936 | 9/1973 | Archer et al. | 343/854 |
| 3,827,055 | 7/1974 | Bogner et al. | 343/754 |
| 3,852,761 | 12/1974 | Bogner | 343/754 |
| 3,940,770 | 2/1976 | Fassett et al. | 343/754 |
| 3,964,069 | 6/1976 | McDonough | 343/854 |
| 3,979,754 | 9/1976 | Archer | 343/854 |

*Primary Examiner*—Alfred E. Smith
*Assistant Examiner*—David K. Moore
*Attorney, Agent, or Firm*—W. G. Christoforo; Bruce L. Lamb

[57] ABSTRACT

In a microwave lens of the Rotman type for a scanning beam antenna a plurality of radiating feed probes are spaced along the focal arc. An illumination function is then commutated around the focal arc by energizing groups of the feed probes simultaneously in accordance with weighting functions to thereby cause the resulting radiated beam to scan in small equally spaced increments while the array factor remains essentially constant. Methods of calculating the weighting functions and feed probe spacing are shown.

4 Claims, 10 Drawing Figures

| WEIGHT SEQUENCE NO. | PROBE K-1 | PROBE K | PROBE K+1 |
|---|---|---|---|
| 0 | 0.78539 | 0.78539 | 0.00000 |
| 1 | 0.70231 | 0.85838 | 0.04517 |
| 2 | 0.61227 | 0.91841 | 0.10204 |
| 3 | 0.51860 | 0.96311 | 0.16996 |
| 4 | 0.42457 | 0.99068 | 0.24767 |
| 5 | 0.33333 | 1.00000 | 0.33333 |
| 6 | 0.24767 | 0.99068 | 0.42457 |
| 7 | 0.16996 | 0.96311 | 0.51860 |
| 8 | 0.10204 | 0.91841 | 0.61227 |
| 9 | 0.04517 | 0.85838 | 0.70231 |
FIG. 8
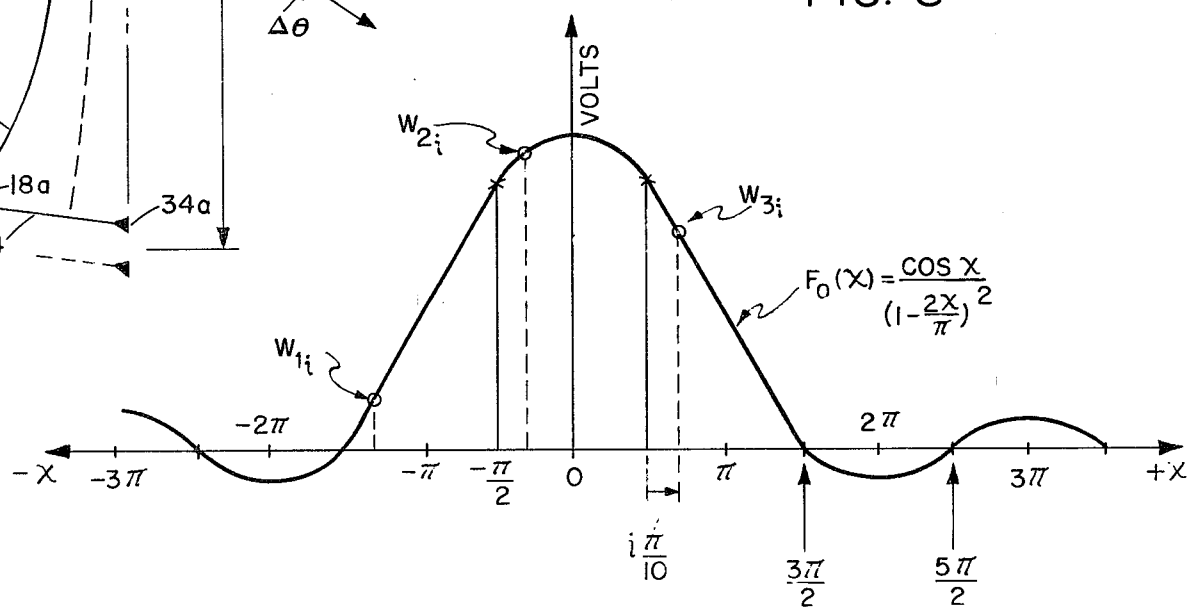
FIG. 7
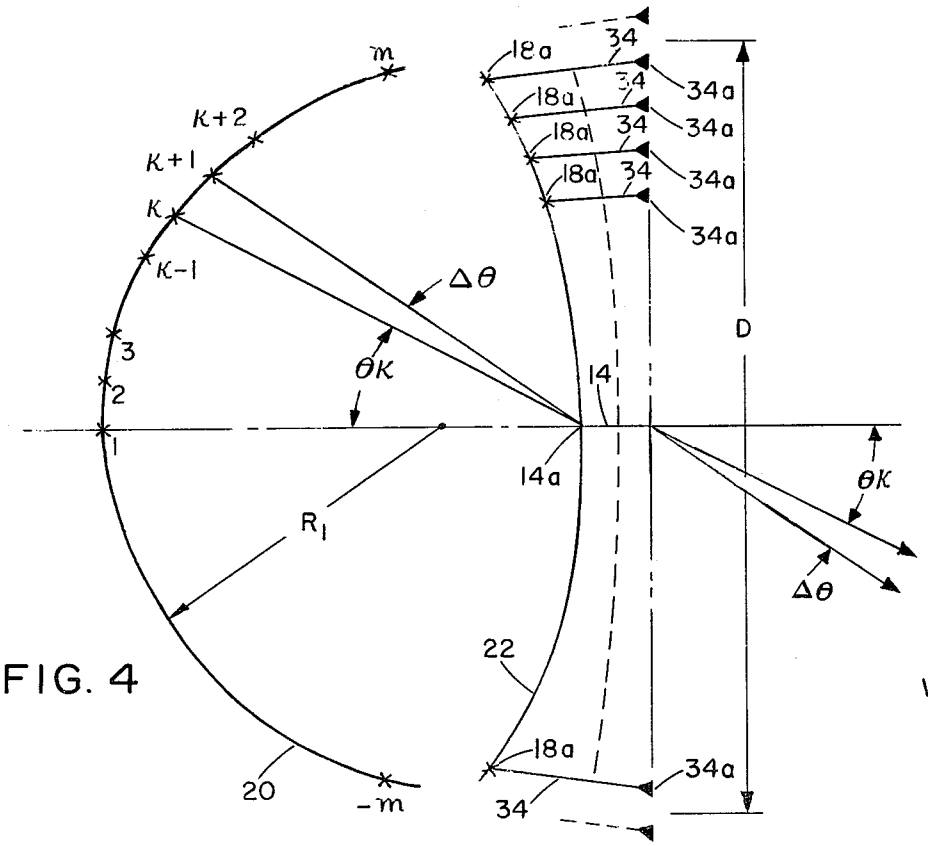
FIG. 4

FINE SCAN MODULATOR TERMINAL
FIG. 10
| (−dB) SEQUENCE NO. | 54a | 54b | 56a | 56b |
|---|---|---|---|---|
| 0 | 0 | 0 | >30 | >30 |
| 1 | 1.73 | 0 | 25.58 | >30 |
| 2 | 3.53 | 0 | 19.09 | >30 |
| 3 | 5.38 | 0 | 15.07 | >30 |
| 4 | 7.36 | 0 | 12.04 | >30 |
| 5 | 9.54 | 0 | 9.54 | >30 |
| 6 | 12.04 | 0 | 7.36 | >30 |
| 7 | 15.07 | 0 | 5.38 | >30 |
| 8 | 19.09 | 0 | 3.53 | >30 |
| 9 | 25.58 | 0 | 1.73 | >30 |
| 10 | >30 | 0 | 0 | >30 |
| 11 | >30 | 1.73 | 0 | 25.58 |
| 12 | >30 | 3.53 | 0 | 19.09 |
| 13 | >30 | 5.38 | 0 | 15.07 |
| 14 | >30 | 7.36 | 0 | 12.04 |
| 15 | >30 | 9.54 | 0 | 9.54 |
| 16 | >30 | 12.04 | 0 | 7.36 |
| 17 | >30 | 15.07 | 0 | 5.38 |
| 18 | >30 | 19.09 | 0 | 3.53 |
| 19 | >30 | 25.58 | 0 | 1.73 |
| 20 | >30 | >30 | 0 | 0 |
| (−dB) SEQUENCE NO. | 54a | 54b | 56a | 56b |
|---|---|---|---|---|
| 21 | 25.58 | >30 | 1.73 | 0 |
| 22 | 19.09 | >30 | 3.53 | 0 |
| 23 | 15.07 | >30 | 5.38 | 0 |
| 24 | 12.04 | >30 | 7.36 | 0 |
| 25 | 9.54 | >30 | 9.54 | 0 |
| 26 | 7.36 | >30 | 12.04 | 0 |
| 27 | 5.38 | >30 | 15.07 | 0 |
| 28 | 3.53 | >30 | 19.09 | 0 |
| 29 | 1.73 | >30 | 25.58 | 0 |
| 30 | 0 | >30 | >30 | 0 |
| 31 | 0 | 25.58 | >30 | 1.73 |
| 32 | 0 | 19.09 | >30 | 3.53 |
| 33 | 0 | 15.07 | >30 | 5.38 |
| 34 | 0 | 12.04 | >30 | 7.36 |
| 35 | 0 | 9.54 | >30 | 9.54 |
| 36 | 0 | 7.36 | >30 | 12.04 |
| 37 | 0 | 5.38 | >30 | 15.07 |
| 38 | 0 | 3.53 | >30 | 19.09 |
| 39 | 0 | 1.73 | >30 | 25.58 |
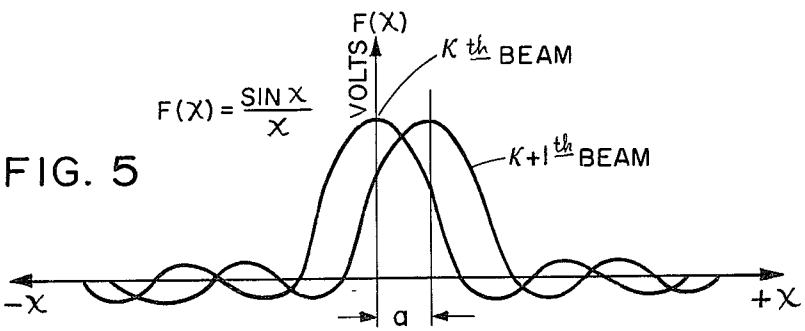
FIG. 5
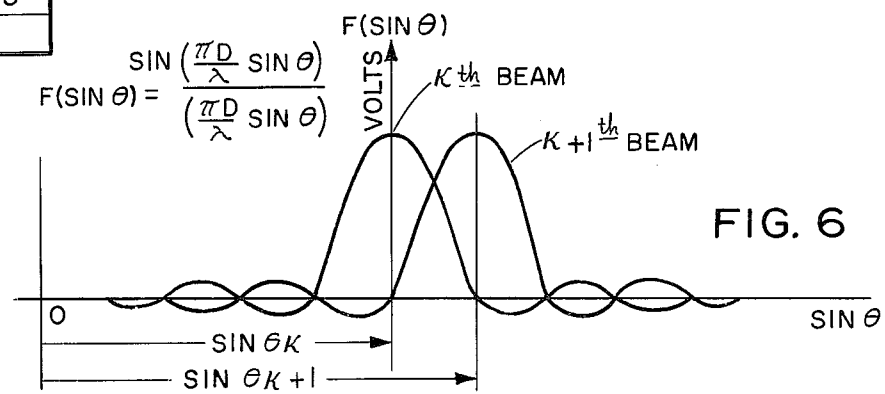
FIG. 6

CONTINUOUS LINE SCANNING TECHNIQUE AND MEANS FOR BEAM PORT ANTENNAS

RELATED PATENT APPLICATION

This application is related to a patent application entitled "Phasing Optimization At The Feed Probes Of A Parallel Plate Lens Antenna" by J. A. Gallant, Ser. No. 752,658 and filed Dec. 20, 1976.

BACKGROUND OF THE INVENTION

This invention relates to wide-angle microwave lens for line source radar antenna applications and in particular to such lens which permit a resulting radiated beam to be scanned in small spaced increments while the array factor remains essentially constant.

Wide-angle microwave lens used as an antenna line source have been known for a long time. One such wide-angle microwave lens has been described in U.S. Pat. No. 3,170,158 for "Multiple Beam Radar System" by Walter Rotman and has come to be known as a Rotman type lens antenna. A typical such lens is comprised of a pair of flat parallel conducting plates which comprise an RF transmission line fed by means for injecting electromagnetic energy into the parallel plate region, a plurality of coaxial transmission lines connected to output probes which extract energy from the parallel plate region, and a linear array of radiating elements fed individually by the coaxial transmission lines radiating energy into space. The physical location of the means for injecting electromagnetic energy into the parallel plate region along a focal arc determines the angle of a beam radiated by the antenna. If the means for injecting is traversed along the focal arc the radiated beam will scan through the antenna field of view. It has been proposed to use a Rotman lens antenna in a microwave landing system (MLS) where the antenna is used to sweep a radiated beam through space at a known rate through known bounds. Thus, an aircraft periodically illuminated by the radiated beam could determine from the characteristics of the illumination its position in space with respect to the radiating antenna. If the radiated beam is swept horizontally then the aircraft could determine its azimuth with respect to the radiating antenna, while a beam swept vertically would provide elevation information to the aircraft, as known to those skilled in the art. Usually one antenna is arranged to sweep a beam vertically, thus providing, for practical purposes, simultaneous azimuth and elevation information to an illuminated aircraft.

The means for injecting has taken the form of a plurality of feed probes positioned along so as to define the focal arc. When the various feed probes are energized so as to feed electromagnetic energy into the parallel plate region one at a time consecutively, the resulting beam will scan through space in distinct steps whose angular separation is directly related to the angular separation between adjacent feed probes. It is desirable, of course, that the aforementioned steps be as small as possible since positional uncertainty at the illuminated aircraft increases as the angular separation between consecutive beams, and hence distance between adjacent feed probes, increases. In short, a smoothly commutated beam provides the best degree of positional certainty at the illuminated aircraft, thus dictating relatively close feed probe spacing. However, if the feed probes are positioned too close to one another adjacent probes will be parasitic to an energized probe, thus distorting its resulting beam shape. One means of providing a well shaped smoothly commutating beam is through the use of a single feed probe instead of the above described plurality and physically scanning the single probe along the focal arc of the lens. This type of scanning probe, however, requires an undesirable mechanism to produce the mechanical motion.

SUMMARY OF THE INVENTION

The present invention comprises another means for producing a smoothly commutated scanning beam from a Rotman lens antenna and comprises the elements of the Rotman lens antenna first described and including the plurality of stationary feed probes. In general, the feed probes are spaced along the focal arc of the lens so that the resultant beam from any feed probe is orthogonal to the beam from an adjacent feed probe. It will be shown below that such spacing eliminates interaction between the various feed probes. A well shaped beam is then scanned through space by providing input power to the lens through an adjacent number of feed probes simultaneously in accordance with a predetermined weighting schedule. As the weights are varied the beam will scan through space. The method of calculating the proper weights will also be shown below.

BRIEF DESCRIPTION OF THE DRAWINGS

FIG. 4 is a conceptual illustration of a Rotman lens antenna constructed in accordance with the invention and includes certain parameters thereof.

FIG. 5 shows arbitrarily spaced sin $x/x$ beams and is helpful in explaining how to calculate optimum feed probe spacing.

FIG. 6 is a plot of beam intensity to sin $\theta$ space for orthogonal beams.

FIG. 7 is a plot in space of the beam far field pattern for beams produced by two adjacent equally excited feed probes.

FIG. 8 is a table of weights calculated in accordance with the showing herein.

FIG. 10 is a table of the relative power applied to the feed probes in an actual lens antenna to provide a scanning beam according to the invention.

DESCRIPTION OF THE PREFERRED EMBODIMENT

Figure 1:
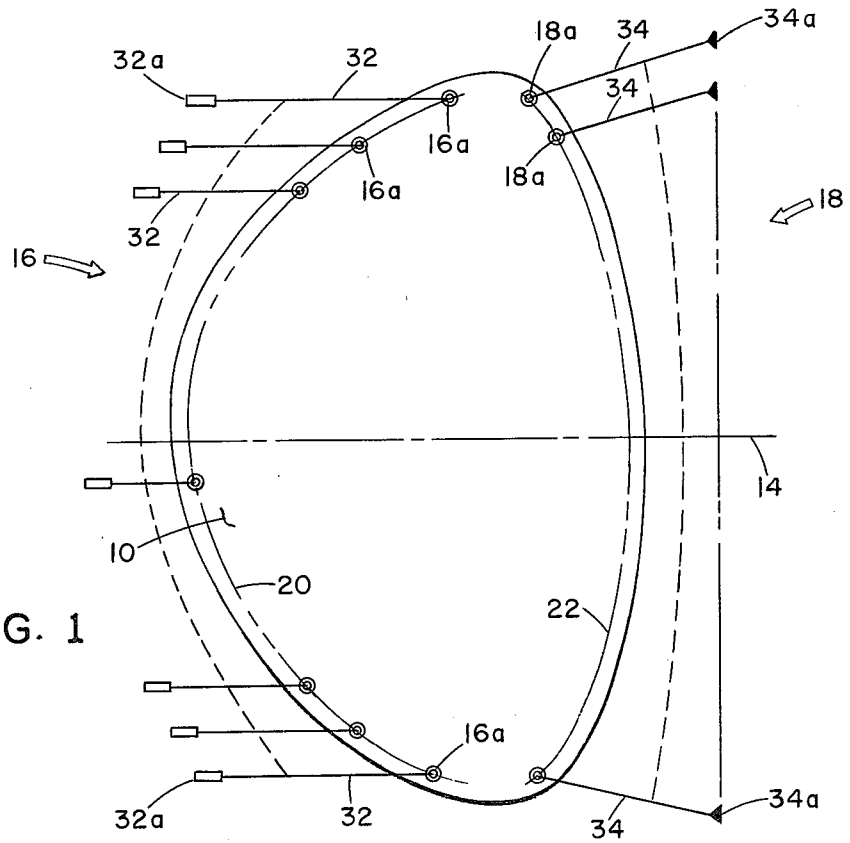
FIG. 1 is a plan view of a Rotman lens antenna.
Figure 2:
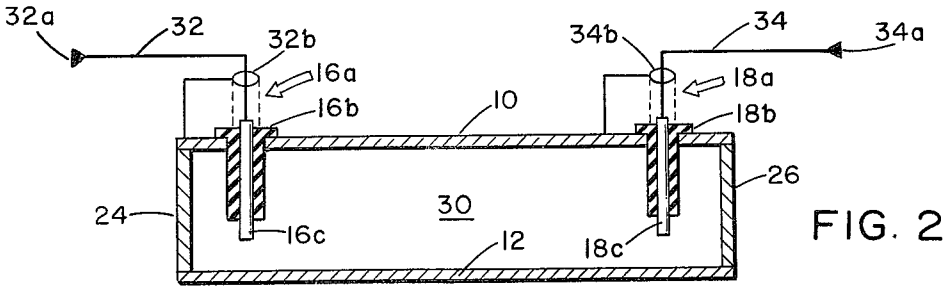
FIG. 2 is a section taken along the longitudinal axis of the lens antenna of FIG. 1.

Refer to the drawings wherein like reference characters refer to like elements in the various figures. In FIGS. 1 and 2 there is seen a microwave lens of the parallel plate type having plates 10 and 12. A longitudinal axis 14 bisects the lens and it is a section along this axis that comprises the view of FIG. 2. Plates 10 and 12 are separated by end plates 24 and 26 at the feed side 16 and output side 18, respectively, of the parallel plate region thus forming a closed cavity 30. End plates 24 and 26 are curved to follow parallel to focal arc 20 and output probe contour 22, respectively.

A plurality of feed probes 16*a*, only one of which is shown in FIG. 2, are inserted in plate 10 along focal arc 20. Each feed probe 16a is comprised of an insulating sleeve 16b and an electrically conductive feed-through pin 16c, one end of which extends into cavity 30 and the other end of which is shown schematically connected via cable 32, suitably coaxial cable, to a connector 32a. As known to those skilled in the art connectors 32a are joined to a source of energy at the appropriate microwave frequencies and the source power distributed or commutated to the various connectors 32a in accordance with the desired scanning direction of the resultant beam.

A plurality of output probes 18a, only one of which is seen in FIG. 2, are inserted in plate 10 along output probe contour 22. The output probes are similar to the feed probes 16a, each output probe 18a being comprised of an insulating sleeve 18b and an electrically conductive feed-through pin 18c, one end of which extends into cavity 30 and the other end of which is shown connected via cable 34, suitably coaxial cable, to an antenna radiating element 34a. Elements 34a comprise a linear array of radiating elements or antennas which radiate a resulting beam into space. The outer conductors 32b and 34b respectively of coaxial cables 32 and 34 are connected in the conventional manner to a common signal return.

Figure 3:
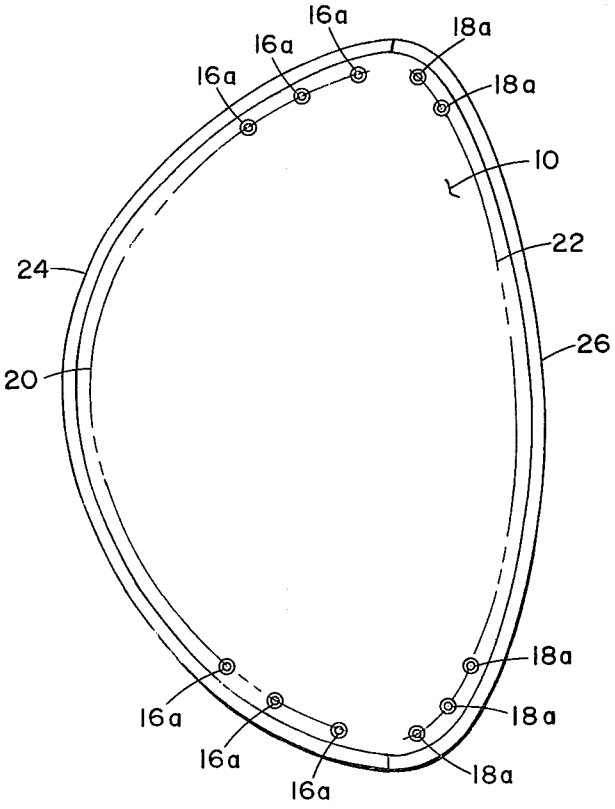
FIG. 3 shows the inside surface of one of the plates comprising a Rotman lens including the feed and outlet probes.

Refer now to FIG. 3 which is a plan view into cavity 30 of FIG. 2 with plate 12 removed. As seen, feed probes 16a are inserted through plate 10 along focal arc 20, while output probes 18a are inserted through plate 10 along output probe contour 22. End plates 24 and 26 are also seen.

Refer now to FIG. 4 where the microwave lens antenna of the earlier figures is conceptualized as having focal arc 20 on radius $R_1$ and an output contour 22. Preferably, arc 20 and contour 22 have symmetry about the longitudinal axis 14. Radiating elements 34a are usually evenly spaced along the antenna aperture D. Radiating elements 34a are colinear and thus form a line array of radiating elements. The antenna aperture D is the linear distance, in this embodiment, between the end elements 34a plus one-half element spacing on each end. The method for determining the length of radius $R_1$, the shape of contour 22 and the spacing of output probes 18a thereon, together with the lengths of cables 34 and the locations of radiating elements 34a, is well known in the prior art and need not be repeated here.

To simplify the notations in the calculations to be shown below the feed probes are numbered in this figure from feed probe #1, which is arbitrarily located on the longitudinal axis 14, to feed probe $m$ on one end of focal arc 20 and feed probe $-m$ on the other end of the focal arc, and include illustrated feed probes $k-1$, $k$, $k+1$ and $k+2$ among others. It should be understood that a feed probe is shown on the longitudinal axis merely as a convenience in the following explanation. In practice a feed probe can be so located or not as will become clear to one skilled in the art from an understanding of the invention.

As known in the art, if only feed probe $k$ is energized at the appropriate microwave frequency, and ignoring parasitic effects of the unenergized feed probes, a beam will be radiated by the antenna array at an angle $\theta_k$ below longitudinal axis 14 where feed probe $k$ is located at an angle $\theta_k$ above longitudinal axis 14. In like manner, if only feed probe $k+1$ is energized the radiated beam will shift to a new angle or azimuth $\theta_{k+1}$ below the longitudinal axis where feed probe $k+1$ is located at an angle $\theta_{k+1}$ above the longitudinal angle.

In order for there to be minimum parasitic interaction between feed probes it is necessary that there be minimum mutual coupling between adjacent feed probes. Consider FIG. 5 where there is shown in $x = \pi D/\lambda \sin\theta$ space the beam resulting from energizing feed probe $k$ and another beam resulting from energizing feed probe $k+1$. The beams are spaced apart by an arbitrary distance "$a$" which corresponds to the actual angular spacing between the two feed probes. The criterion for minimum mutual coupling between feed probes $k$ and $k+1$ is:

$$\int_{-\infty}^{\infty}\left[W_k\frac{\sin x}{x}\right]^2 dx + \int_{-\infty}^{\infty}\left[W_{k+1}\frac{\sin(x-a)}{(x-a)}\right]^2 dx = \int_{-\infty}^{\infty}\left[W_k\frac{\sin x}{x} + W_{k+1}\frac{\sin(x-a)}{(x-a)}\right]^2 dx. \quad (1)$$

The above equation expresses mathematically that the radiated power in space resulting from both feed probes $k$ and $k+1$ being turned on simultaneously is equal to the sum of the radiated power due to each feed probe being turned on with the other off.

Stated in another way and assuming a lossless lens: if power $P_k$ is input to probe $k$ when probe $k+1$ is off then the radiated power in beam $k$ will be $P_k$. Alternately when the $k^{th}$ probe is off input power $P_{k+1}$ into the $k+1^{th}$ probe will produce radiated power $P_{k+1}$. Now consider the situation when the $k^{th}$ probe is energized with power $P_k$ and the $k+1^{th}$ probe was already energized with $P_k+1$ and therefore was radiating $P_{k+1}$ power into space. If the new total radiated power increases to $(P_k + P_{k+1})$ then the $k^{th}$ probe had no way of knowing if the $k+1^{th}$ probe was on or not. If, however, the total radiated power did not increase by the amount input into the $k^{th}$ probe the only explanation was that power must have been reflected from the $k^{th}$ input probe. This reflected power can be interpreted as power coupled from the $k+1^{th}$ input. In any event under these circumstances the $k^{th}$ probe looks into a mismatch, whereas with $k+1$ turned off the $k^{th}$ input was matched having no reflected power.

Equation (1) can be solved for the values of probe spacing "$a$" which will result in no mutual coupling. This is done by expanding the integrand of the right side of equation (1) and canceling equal terms on either side of the equation resulting in:

$$W_k W_{k+1} \int_{-\infty}^{\infty} \frac{\sin x}{x}\,\frac{\sin(x-a)}{(x-a)}\,dx = 0. \quad (2)$$

But the integral in equation (2) is a convolution integral. The sinc $(x)$ function is being convolved with itself with respect to the variable "$a$". The above equation can be rewritten in the more compact form of equation (3) below:

$$\text{sinc}\,(x) * \text{sinc}\,(x) = 0 \quad (3)$$

where * denotes convolution,

-continued $$\text{and sinc}(x) \equiv \frac{\sin x}{x}.$$

But the sinc $(x)$ function convolved with itself results in another sinc function. This is apparent if one realizes that convolution in the $x$ domain becomes multiplication in the Fourier Transform domain. Thus, if the transform of sinc $(x)$ is multiplied by the transform of sinc $(x)$ and then the inverse transform of this product is taken, the desired result is obtained. But the transform of sinc $(x)$ is a rectangle function namely:

$$\text{sinc}(x) <=> \pi\text{rect}(\pi y)$$

where $<=>$ denotes "Fourier Transforms to".

Therefore:

$$\text{sinc}(x) * \text{sinc}(x) <=> [\pi\text{rect}(\pi y)]^2.$$

It follows from the definition of the Fourier Transform that:

$$\text{sinc}(x) * \text{sinc}(x) = \pi^2 \int_{-\infty}^{\infty} [\text{rect}(\pi y)]^2 e^{j2\pi ay} dy. \quad (4)$$

Evaluating the integral transform on the right side of equation (4) results in:

$$\text{sinc}(x) * \text{sinc}(x) = \pi\text{sinc}(a). \quad (5)$$

Accordingly, the values of "$a$" which cause sinc $(a)$ to equal zero, that is, the values of "$a$" which result in minimum mutual coupling between probes are $a = n\pi$, where $n$ is any integer except 0. By definition, the two sinc $(x)$ functions are said to be orthogonal for the above values of "$a$" since their integrated product is zero. The beams represented by the sinc $(x)$ functions are similarly said to be orthogonal to one another. Since a sin $x/x$ beam has first nulls at $\pi$ and $-\pi$ and subsequent nulls at integral multiples thereof, it is clear that the feed probes, in order that there be minimum mutual coupling, must be separated so that the nose or maximum peak of the beam resulting from energizing a particular probe must be at the first null of the beam resulting from energizing an adjacent feed probe. Referring to FIG. 6 there is seen orthogonal beams $k$ and $k + 1$ in sin $\theta$ space. The variable $x$ in FIG. 5 becomes $\pi D/\lambda \sin\theta$ in FIG. 6 as is known to one versed in the art.

Two other facts are known from FIG. 6, the width of a beam between its first nulls is $2\lambda/D$, while the nose of a beam resulting from energizing feed probe $k$ is at sin $\theta_k$ on the sin $\theta$ axis and the nose of the beam resulting from energizing feed probe $k + 1$ is sin $\theta_{k+1}$ on the same axis.

where

D is the lens aperture and $\lambda$ is the wavelength, then $$\lambda/D = \sin\theta_{k+1} - \sin\theta_k = 2\cos[\tfrac{1}{2}(\theta_{k+1} + \theta_k)]\sin[\tfrac{1}{2}(\theta_{k+1} - \theta_k)],$$

therefore:

$$\lambda/D = \Delta\theta\cos\theta_k,$$

or stated differently:

$$\Delta\theta = \lambda/(D\cos\theta_k) \quad (6)$$

where $\theta_k$ is as shown in FIG. 4. By use of equation (6) the spacing of the feed probes along focal arc 20 can be calculated for minimum mutual coupling.

It should now be obvious that a well shaped beam can be scanned through space using a Rotman lens antenna having the feed probes spaced as described herein by energizing each feed probe in turn and simultaneously deenergizing the others. However, as previously stated, this produces a beam which steps through space in $\Delta\theta$ steps rather than a smoothly commutated beam. By energizing several adjacent feed probes in accordance with a suitable set of weights, which can be computed, it is possible to cause a resultant composite antenna beam to have a suitable sidelobe level here assumed to be $-23$ db. If these weights are then changed according to a prescribed sequence the beam can be made to step in angular increments which can be any fraction of the angle between feed probes. The beam shape can be maintained essentially constant (in sine angle space) and the sidelobe levels can be maintained below the prescribed level. The method for calculating these weights is shown below with the requirement that the beam is to be moved in increments of one-tenth the feed probe spacing, although it should be clear after reading and understanding this showing that sets of weights which will permit the beam to be moved in any increment can be calculated. A further ground rule is that a minimum number of adjacent feed probes are to be excited simultaneously, limited only by the fine steering accuracy specifications and the maximum permitted angle sidelobe level.

Using the above ground rules it is first necessary to determine the minimum number of orthogonally spaced feed probes which, when excited would produce an antenna pattern with maximum sidelobes below the specified limit. Two adjacent feed probes equally excited will produce a beam in space with a theoretical $-23$ db first sidelobe level. This beam is the superposition of two orthogonal sin $x/x$ beams. The shape of this antenna pattern (array factor) is given by:

$$F_o(x) = \frac{\pi}{2}\left[\frac{\sin(x - \frac{\pi}{2})}{(x - \frac{\pi}{2})} + \frac{\sin(x + \frac{\pi}{2})}{(x + \frac{\pi}{2})}\right]. \quad (7)$$

Simplifying the above by trigonometric manipulation produces:

$$F_o(x) = \frac{\cos x}{1 - \left(\frac{2x}{\pi}\right)^2}. \quad (8)$$

The expression for $F_o(x)$ above gives the shape of the far field pattern in space, (neglecting the element pattern) of two equally excited feed probes. The beam amplitude has been normalized to unity at its nose and the variable $x$ represents the sine angle variable conventionally used when computing line array patterns. The distance between the first nulls of the sin $x/x$ patterns is normalized to $2\pi$ for simplicity. The actual angular extent between first null points of each sin $x/x$ is $2\lambda/D$ in sine angle space as noted above and the adjacent sin $x/x$ beams are separated by one-half of this, or $\lambda/D$. The 3 db beamwidth of the resulting 2 probe excitation is 1.35 times greater than the sin $x/x$ beam and the directive gain is 0.91 db less than the sin $x/x$ beam. Though this does not represent the most efficient array illumination possible for the 23 db sidelobe level, it is simple to produce and is an acceptable solution. This two probe excitation produces a cosine voltage illumination function across the radiating antenna aperture which is the acceptable beam shape in the present embodiment. The sampling theorem is now used to establish the weights required to produce a shifted version of this same beam shape. FIG. 7 is helpful in explaining the sampling concept. The sampling theorem states that the $F_o(x)$ function can be exactly reproduced by summing an infinite number of sin $x/x$ functions spaced by $\pi$ and weighted according to the $F_o(x)$ function. These sin $x/x$ functions can all be arbitrarily shifted under the original $F_o(x)$ function so long as they remain equally spaced. A good approximation of the $F_o(x)$ function can be obtained by assuming all sample values are zero except the ones located under the main lobe of the $F_o(x)$ function. The sacrifice in truncating the samples is a slight variation of beam shape as a function of sample location. FIG. 7 shows that a maximum of three samples $W_{1i}$, $W_{2i}$ and $W_{3i}$ can be taken, spaced by $\pi$, under the main lobe of the $F_o(x)$ function. There can be no less than two nor more than three samples under the main lobe at any one time.

The value of the weights or samples is:

$$W_{1i} = \frac{\cos Z_i}{\left[1 - \frac{2Z_i^2}{\pi}\right]} \tag{9}$$

$$W_{2i} = \frac{\cos (Z_i + \pi)}{\left[1 - \left(\frac{2(Z_i + \pi)}{\pi}\right)^2\right]} \tag{10}$$

$$W_{3i} = \frac{\cos (Z_i + 2\pi)}{\left[1 - \left(\frac{2(Z_i + 2\pi)}{\pi}\right)^2\right]} \tag{11}$$

where $z_i = -3\pi/2 + i\,\pi/10$ and $i = 0, 1, \ldots 9$. Note than when $i = 0$ or 9 equations (10) and (11) become indeterminate. The values are determined by considering the values of equations (9), (10) and (11) for $i \neq 0$ or 9 and realizing the need for a smoothly commutating beam. These values are determined to be:

$$W_{1_o} = W_{1_9} = 0$$

$$W_{2_o} = W_{2_9} = \pi/4$$

$$W_{3_o} = W_{3_9} = \pi/4.$$

Even more generally, the sampling theorem permits one to calculate weights to allow the antenna beam to be moved any number, I, of steps through the angle $\Delta\theta$ of FIG. 4. In addition, any practical maximum odd number, K, of feed probes can be simultaneously excited. According to the sampling theorem the general equation for the various weights is, assuming the feed probes are spaced along the focal arc as explained above:

$$W_{ki} = \frac{\cos [Z_i + (k-1)\pi]}{\left[1 - \left(\frac{2[Z_i + (k-1)\pi]}{\pi}\right)^2\right]}$$

$$\text{where: } Z_i = -\frac{K\pi}{2} + i\frac{\pi}{I}$$

$k = 1, 2, 3, \ldots$ K and K is the total number of simultaneously excited probes. K is any odd number 3, 5, 7, 9, $\ldots$ $i = 0, 1, 2, \ldots$ (I-l) and I is the total number of discrete steps between scan angle $\theta_k$ and $\theta_{k+1}$ in FIG. 4. The subscript $k$ refers to which of the K probes is being excited when calculating $W_{ki}$. The subscript $i$ refers to which scan increment is being considered when calculating the $W_{ki}$.

Figure 9:
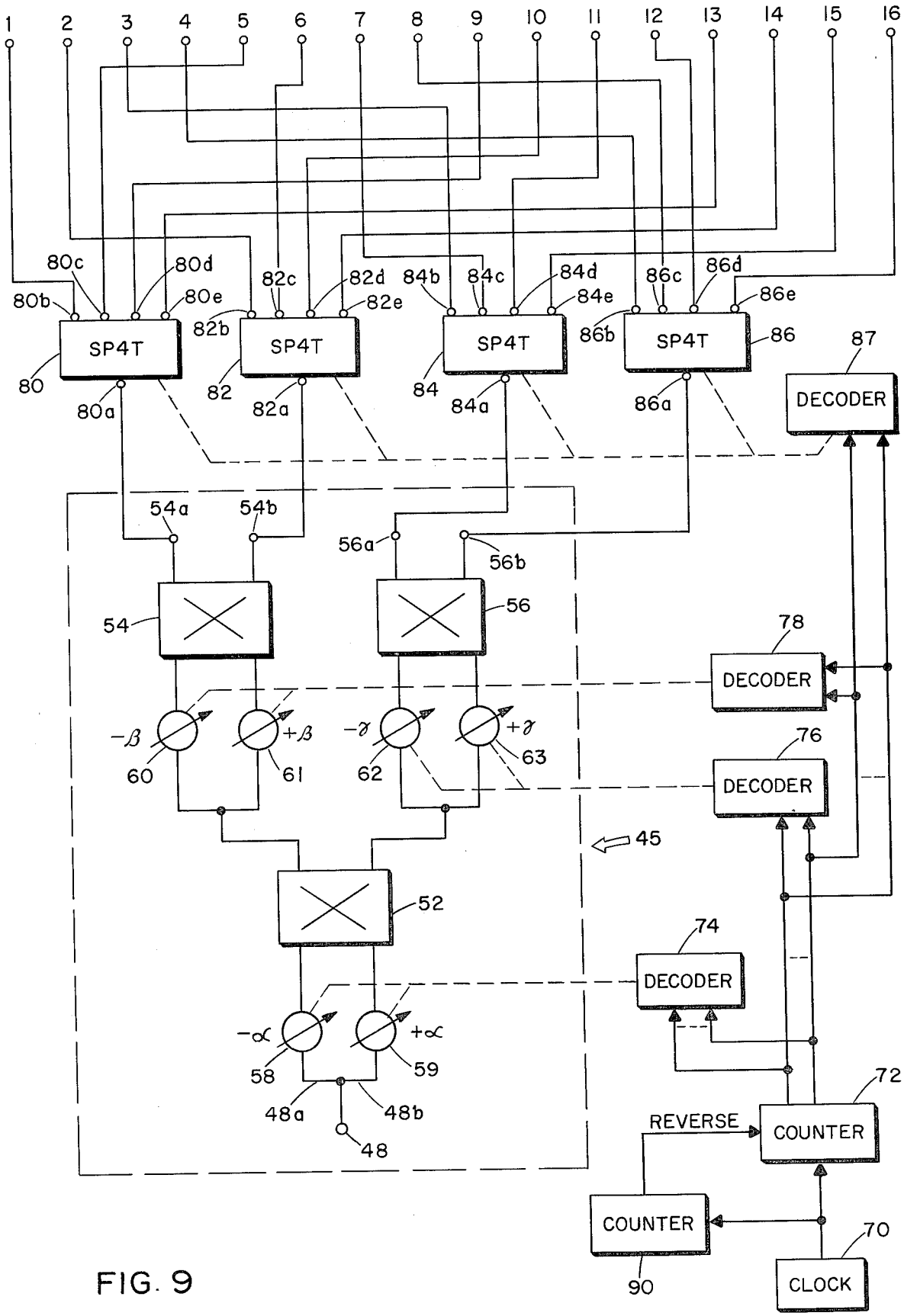
FIG. 9 is a modified block diagram which is helpful in explaining how weights can be applied to a microwave lens.

FIG. 8, reference to which should be made, is a table of weight values calculated by the use of equations (9), (10) and (11). Note that there are ten unique sets of weights in this embodiment corresponding to the ten steps of the antenna beam to move through the angle $\Delta\theta$ of FIG. 4. The means by which the power to the feed probes of the lens is varied in accordance with the calculated weights is shown in FIG. 9, reference to which should now be made. It is assumed in the following description that the antenna beam is to be commutated or scanned from one limit of its travel to the other and return. However, as the description proceeds it should become obvious to one skilled in the art that any scanning program can be followed by modification of the invention. FIG. 9 shows a power input terminal 48 which is connected to receive a microwave frequency signal and a low loss fine scan modulator 45 which distributes the input signal in accordance with the weights of the table of FIG. 8 to the feed probes of FIG. 1. To accomplish this function the preferred fine scan modulator is simply a microwave power divider built in accordance with principles well known in the art and comprised of variable phase shifters 58 through 63° and 90° hybrids 52, 54 and 56. One type of microwave power divider using variable phase shifters and 90° hybrids is described in the article "A Variable Ratio Microwave Power Divider and Multiplexer" by Teeter and Bushore which appeared October 1957 in the I.R.E. Transactions on Microwave Theory and Techniques published by the Professional Group on Microwave Theory and Techniques. As known to those skilled in the art, manipulation of the various phase shifters can be employed to cause all the power applied at input terminal 48 to appear at any one of the output terminals **54*a*, 54*b*, 56*a* or 56*b*** with no power appearing at the other output terminals, or the input power to be distributed in accordance with a weighting schedule to the various output terminals. As common in the art, the term "no power" at an output terminal is taken to mean that power at that output terminal is below some practical lower limit. In an embodiment actually built this lower limit was taken as −30 db.

As shown, terminal 48 is connected via lines **48*a* and 48*b* to variable phase shifters 58 and 59. The phase shifted signals from these phase shifters are applied to the 90° hybrid 52 whose output lines 52*a* and 52*b* are connected, respectively, to variable phase shifters 60, 61 and 62, 63. The phase shifted signals from phase shifters 60 and 61 are applied to 90° hybrid 54 whose output lines comprise terminals 54*a* and 54*b*. In like manner, the phase shifted signals from phase shifters 62 and 63** are applied to 90° hybrid 56 whose output lines comprise terminals 56*a* and 56*b*.

In this embodiment, the variable phase shifters of fine scan modulator 45 are controlled by decoders 74, 76 and 78 in response to the count in counter 72 which receives pulses from clock 70. The various decoders comprise read only memories (ROM's) which, in essence, are programmed to include the weight information of FIG. 8 in the form of a "look-up" table and are addressed by the count contained in counter 72. The various phase shifters are digitally controlled phase shifters whose degree of phase shift is set by a digital signal received from the applicable decoder. In particular, decoder 74 controls phase shifters 58 and 59, decoder 76 controls phase shifters 60 and 61, and decoder 78 controls phase shifters 62 and 63. ROM's in the form of look-up tables which are addressed by a digital signal and digitally controlled phase shifters are well known in the art, thus an exhaustive description of these elements and their interconnections is not necessary.

The weighted outputs from fine scan modulator 45 are connected to single pole, four throw (SP4T) switches 80, 82, 84 and 86. In particular, terminal 54*a* is connected to the pole 80*a* of SP4T switch 80, terminal 54*b* to the pole 82*a* of switch 82, terminal 56*a* to the pole 84*a* of switch 84 and terminal 56*b* to the pole 86*a* of switch 86. The switches connect the weighted power signals from the fine scan modulator 45 to the feed probes of the lens antenna of FIG. 1. It is here (in FIG. 9) assumed that there are sixteen feed probes, numbered in sequence from #1 to #16. The "throw" positions, for example with respect to switch 80, the positions 80*b*, 80*c*, 80*d* and 80*e*, are connected, respectively, to each fourth feed probe, the "throw" positions of switch 80 being connected, respectively, to feed probes 1, 5, 9 and 13, of switch 82 to feed probes 2, 6, 10 and 14, of switch 84 to feed probes 3, 7, 11 and 15 and to switch 86 to feed probes 4, 8, 12 and 16. As explained in the above referred related patent application, coaxial cables are used to respectively connect the switches to the various feed probes and the lengths of these cables are preferably predetermined so that the signals at the various feed probes (referring to FIG. 1) appear to be coherent with one another as observed at the intersection of longitudinal axis 14 and contour 22.

Referring again to FIG. 9, in the actually built embodiment of the invention switches 80, 82, 84 and 86 were implemented as solid state switches so as to provide rapid operation. In addition, for economical use of the hardware involved and although the ten sets of weights of FIG. 8 were employed to step the antenna beam in ten small steps through the angle $\Delta\theta$ the circuitry of FIG. 9 was used to step the antenna beam through an angle of 4 times $\Delta\theta$ in forty small steps and then repeat to sweep the antenna beam through the field of interest. In other words, the phase shifters of FIG. 9 were programmed by the decoders to move through a cycle of forty steps and, of course, the ROM in each decoder contained the information for each of these steps. In addition, counter 72 accumulated forty pulses from clock 70 (from binary count 0 to 39) and then repeated.

Refer now to FIG. 10 which is a table which illustrates how the input power to fine scan modulator 45 is distributed to the output terminals thereof in the forty step cycle of the actual embodiment. In this figure the −db levels of the power at the various output terminals is tabulated. These db levels of course correspond to the weights of FIG. 8. Note that the table of FIG. 10 repeats each ten sequences but displaced one place to the right. The table repeats exactly every forty steps. For example, at sequence 0 the phase shifters are set to divide the input power on input terminal 48 in half, with half the power appearing at terminal 54*a* and half at terminal 54*b*. (Note that as explained above a −30 db power level is assumed to be no power. Also, −0 db in this embodiment is one-half the input power.) Sequence 0 repeats every forty counts of counter 72. Sequences 10, 20 and 30 are similar to sequence 0 in that the input power is split evenly onto two output terminals. They differ, as mentioned above, in that the power levels are moved one place to the right; at sequence 10 power is shared by terminals 54*b* and 56*a*, at sequence 20 power is shared by terminals 56*a* and 56*b*, and at sequence 30 power is shared by terminals 54*a* and 56*b*.

The switches of FIG. 9 are controlled by a decoder 87, preferably another ROM, which is addressed once for each ten counts of counter 72.

The operation of the circuit of FIG. 9 to provide a smoothly commutated antenna beam is as follows, referring to FIGS. 9 and 10. A constant power signal is applied at terminal 48. At initial conditions, assumed as sequence 0 and all switch poles conceptually to the left, the input power is equally split to feed probes 1 and 2. Over sequences 0 to 9 the power is distributed, by variation of the phase shifters, in accordance with the table of FIG. 10, while the switches remain in a constant position. At sequence 10 decoder 87 interprets the count in counter 72 so as to cause the pole of switch 80 to move one step to the right, to make connection between terminals 80*a* and 80*c* and the power distributed, now to feed probes 2, 3, and 4 during sequences 10 through 19 in accordance with the table of FIG. 10. (Note that in accordance with the table of FIG. 10 no power is delivered to feed probe 5 during sequences 10 through 19, even though terminal 54*a* is connected thereto through switch 80.) At sequence 20 decoder 87 interprets the count in counter 72 to cause the pole of switch 82 to move one step to the right to make connection between terminals 82*a* and 82*c* and the power distributed to feed probes 3, 4 and 5 during sequences 20 through 29 in accordance with the table of FIG. 10. This operation continues until the beam has been swept across the field of interest. At that time all switch poles will be conceptually to the right extreme position.

Since in this embodiment it is desired to sweep or scan the resulting antenna beam back and forth through the field of interest, it is necessary at the completion of a scan in one direction as described that counter 72 be reversed in operation. Counters of this type are known in the art and their direction of count can be easily controlled by providing another counter which merely cyclically accumulates the number of pulses from clock 70 required to sweep the antenna beam through the field of interest and at that time generate a signal to reverse the operation of counter 72. In this embodiment counter 90 is provided for this purpose and it generates a reverse command signal which is applied to counter 72 every other 160 pulses from clock 70. While the reverse command signal is applied to counter 72 that counter will decrement one count for each pulse applied thereto from clock 70.

As known to those skilled in the art the fine scan modulator or power divider of FIG. 9 can be built with only three phase shifters, for example, with phase shifters 58, 60 and 62. For the embodiment shown the phase shifters used in the actual embodiment of the invention were 6 bit phase shifters of 45°, 22.5°, 11.25°, 5.625°, 2.8125° and 1.40625° and were controlled so that the phase shift introduced by one phase shifter was equal and opposite to the phase shift introduced by its associated phase shifter. For example, phase shifter 59 introduces a phase shift of $+\alpha$, while phase shifter 58 introduces a phase shift of $-\alpha$. Of course, if only three phase shifters are used as suggested above then the phase shift bits would be 90°, 45°, 22.5°, 11.25°, 5.625° and 2.8125°.

Having described our invention, certain modifications and alterations thereof should now be obvious to one skilled in the art. For example, following our teachings of stepping an antenna in relatively small steps one should now be able to calculate weights which will permit the resulting beam to be scanned in any practical number of steps, while maintaining a well shaped beam and to design a fine scan modulator therefor. By continuously adjusting the phase shifters of FIG. 9 it is even possible to provide practically continuous, stepless scanning of a resulting beam. It should also be possible to adapt the invention to provide any predetermined scanning pattern or to provide external control signals to steer the beam as required. Also, one not constrained by the available hardware could design a fine scan modulator in accordance with the teachings of this invention which completes a cycle in fewer or more sequences than described herein. Accordingly, the invention is to be limited only by the scope and true spirit of the appended claims.

The invention claimed is:

1. A radar antenna system including radiating means for scanning radiated energy comprising a parallel plate wave conducting lens having a plurality of individually excitable input means located along the focal arc of said lens for supplying energy to said lens and wherein a plurality of contiguous input means is to be excited simultaneously and a plurality of output means for extracting energy, said output means being connected to said radiating means, and wherein exciting the $k^{th}$ of said input means results in a first radiated beam at an angle of $\theta_k$ and exciting the $k + 1^{st}$ of said input means results in a radiated beam at an angle of $\theta_{k+1}$, means for scanning said beam in I steps between $\theta_k$ and $\theta_{k+1}$ comprising means for exciting a plurality of contiguous output means and weighting the exciting power in accordance with weights $W_{ki}$, where:

$$W_{ki} = \frac{\cos\left[Z_i + (k-1)\pi\right]}{\left[1 - \left\{\frac{2[Z_i + (k-1)\pi]}{\pi}\right\}^2\right]}$$

$$\text{where: } Z_i = -\frac{K\pi}{2} + i\frac{\pi}{I}$$

and $i = 0, 1, 2, \ldots (I\text{-}1)$ $k = 1, 2 \ldots K$, K being the maximum number of input means to be excited simultaneously.

2. The radar antenna system of claim 1 wherein K = 3.

3. The radar antenna system of claim 1 wherein the $k^{th}$ of said input means is spaced from said $k + 1^{st}$ of said input means so that the beam radiated by exciting the $k^{th}$ input means is orthogonal to the beam radiated by exciting the $k + 1^{st}$ input means.

4. The radar antenna system of claim 1 wherein said lens has a longitudinal axis and wherein the $k^{th}$ input means is angularly spaced from the $k + 1^{st}$ input means by an angle $\Delta\theta$ where:

$$\Delta\theta = \lambda/(D \cos \theta_k)$$

and where $\lambda$ is the wavelength of the radiated energy, D is the antenna aperture and $\theta_k$ is the angle between said longitudinal axis and a line connecting said $k^{th}$ input means to the intersection of said longitudinal axis with an arc drawn through said output means, the angle $\Delta\theta$ being taken with said intersection as a center.

* * * * *